United States Patent [19]

Blanchard

[11] 4,300,904

[45] Nov. 17, 1981

[54] DYEING OF CELLULOSE-CONTAINING TEXTILES IN GLYCOL AND GLYCOL ETHER SOLVENTS

[75] Inventor: Eugene J. Blanchard, New Orleans, La.

[73] Assignee: The United States of America as represented by the Secretary of Agriculture, Washington, D.C.

[21] Appl. No.: 171,626

[22] Filed: Jul. 23, 1980

[51] Int. Cl.[3] ..... D06P 3/82

[52] U.S. Cl. ..... 8/532; 8/552; 8/611; 8/620; 8/652; 8/680; 8/681; 8/918; 8/930

[58] Field of Search ..... 8/532, 552, 611, 609, 8/618, 918, 620, 652, 680, 681, 930

[56] References Cited

U.S. PATENT DOCUMENTS

| | | | |
|---|---|---|---|
| 3,706,525 | 12/1972 | Blackwell et al. | 8/532 |
| 3,744,967 | 7/1973 | Thackrah | 8/499 |
| 4,056,354 | 11/1977 | Pittman et al. | 8/533 |

FOREIGN PATENT DOCUMENTS 760041 10/1956 United Kingdom .

*Primary Examiner*—A. Lionel Clingman
*Attorney, Agent, or Firm*—M. Howard Silverstein; David G. McConnell; Raymond C. VonBodungen

[57] ABSTRACT

The dyeing of cotton in glycol and glycol ether solvents containing direct or sulfur dyes is disclosed. Prior to dyeing, the fabric is treated with an aqueous solution to swell the fibers. When the pretreated cotton is dyed in solvent containing 0.25% to 2% potassium thiocyanate it results in improved color saturation. The instant invention is extremely effective for either cotton or cotton/polyester blends.

8 Claims, No Drawings

DYEING OF CELLULOSE-CONTAINING TEXTILES IN GLYCOL AND GLYCOL ETHER SOLVENTS

BACKGROUND OF THE INVENTION (1) Field of the Invention

This invention relates to the dyeing of fabrics.

More specifically, this invention relates to the dyeing of cotton and cotton blends in glycol and glycol ether solvents containing suitable dyestuffs such as direct, sulfur, and disperse dyestuffs.

(2) Description of the Prior Art

The most common solvent for dyeing cotton textiles is water because the solvent provides good solubility of the dyestuffs and contributes to fiber swelling to allow the dye to penetrate the fiber. Chlorinated solvents such as 1,1,1-trichloroethane, trichloroethylene, and perchloroethylene have been used for preparation, finishing, and dyeing of textiles. The major disadvantage of these solvents for dyeing textiles is that polar dyestuffs are not readily soluble in them. Glycol solvents, such as ethylene glycol and diethylene glycol, have been used for dyeing polyamide and polyester textiles. British Pat. No. 760,041 teaches the use of solvents such as ethylene glycol and diethylene glycol for dyeing textile fibers with suitable dyestuffs at temperatures as high as 188° C. for eight to ten seconds. However, these solvents are very poor for dyeing cotton.

Pittman et al, U.S. Pat. No. 4,056,354, has demonstrated that natural fibers, such as wool, can be dyed in ethylene glycol at about 150° C. for 30 seconds or less. Blends of wool and synthetic fibers can also be effectively cross-dyed by using acid dyes and suitable synthetic dyes in the same bath.

SUMMARY OF THE INVENTION

In all prior work, no process has been described in which cotton-containing textiles have been treated with water or an aqueous solution containing an inorganic salt and then dyed in glycol and glycol ether solvents with direct and sulfur dyes. Also, no process has been described in which cotton is treated with water and then dyed in glycol or glycol ether solvent containing an inorganic salt such as potassium thiocyanate. Furthermore, no process has been described to produce crossdyed fabric by treating with an aqueous solution and then dyeing in glycol and glycol ether solvents containing direct or sulfur and disperse dyes in the same bath.

This invention describes a method for dyeing cotton-containing fabrics with direct and sulfur dyes in glycol and glycol ether solvents. The method comprises treating the fabric with an aqueous solution, placing the fabric in a dye bath after treating with the aqueous solution, and dyeing the fabric in a solution containing a cotton dye. The solvent can be either a glycol or glycol ether. The fabric is then rinsed to remove excess dye.

DESCRIPTION OF THE PREFERRED EMBODIMENTS

We have found that cotton can be dyed in glycol and glycol ether solvents with direct and sulfur dyes when the textile is properly pretreated to insure good dye uptake. We have also found that blends of cotton and polyester can be dyed in these solvents with direct or sulfur dyes and disperse dyes in the same dyebath. This is particularly important because it allows the crossdyeing of cotton/polyester blends by using two dye classes in one dyebath at temperatures of 150° C. and higher. This greatly simplifies the dyeing process and reduces the dyeing time.

The simplest pretreatment for cotton necessary for good dyeing in glycol and glycol ether solvents is to soak the material in water to induce fiber swelling. Contact time prior to entry into the dyebath can range from a few seconds to several hours, but the usual time to insure adequate swelling is 5 to 10 minutes. Excess water is removed by padding to 50 to 100% wet pickup. The fabric can then be dyed with direct or sulfur dye in glycol or glycol ether solvent. The solvents used are selected from a group consisting of monomethyl ethers of ethylene glycol, diethylene glycol, triethylene glycol, tetraethylene glycol, and polyethylene glycol with molecular weights of 400 to 600 as well as the corresponding methoxy derivatives with molecular weights of 350 to 750. The concentration of dyestuff ranged from 0.5 to 20% based on the weight of the fabric (wof) and the liquor to fabric ratio was usually 20:1. Dyeing was conducted at 50° C. to 160° C. for 1.0 to 20 minutes.

After dyeing for the designated time the fabric was rinsed either in water or low molecular weight alcoholic solvent to remove excess dyestuff. The sample was then dried at 25° to 100° C.

Improved color yield was obtained by pretreating the fabric with an aqueous solution containing an inorganic salt. The salt is selected from the group consisting of ammonium, potassium, and sodium thiocyanate but the preferred salt is potassium thiocyanate (KSCN). Other salts, such as sodium chloride and zinc chloride, can be used but they are less effective than potassium thiocyanate. The fabric is treated with an aqueous solution containing about 2.5% to 20% of the salt to 50–100% wet pickup. The fabric is then dyed in the appropriate glycol or glycol ether solvent containing direct, sulfur, or combinations of these dyes and disperse dyes for dyeing cotton/polyester blend fabrics. The fabric also can be dried after the pretreatment with KSCN and then dyed later. The results are identical to those obtained when the fabric is treated and then dyed without an intermediate drying step when 20% KSCN is used.

Color yield is also improved when fabric is pretreated with water and then dyed in a dyebath containing from about 0.25% to about 2.0% KSCN.

The following examples further describe the invention. They are given as illustrations and thus should not be considered as limiting the scope of the invention.

EXAMPLE 1

Cotton fabric was soaked in water for 10 minutes to promote fiber swelling and then padded to 100% wet pickup. The wet fabric was then dyed in ethylene glycol monomethyl ether containing 5% Direct Blue 78 based on the weight of the fabric (wof). The fabric was dyed at 100° C. for 20 minutes and then rinsed with water and dried. The fabric was dyed a deep blue color.

The photovolt reflectance (based on the percent of the undyed control fabric) was 4.6 compared to 3.8 for the conventionally aqueous dyed fabric. This shows that cotton can be dyed in a glycol ether solvent effectively.

EXAMPLE 2

Cotton fabric was pretreated and dyed as in Example 1 except the solvent used for dyeing was ethylene glycol. The photovolt reflectance was 43.8. This shows that ethylene glycol is not a good solvent for dyeing cotton with direct dye compared to some other glycols and glycol ethers. However, color saturation can be increased by increasing the concentration of dye in the solvent. Even when dyeing was conducted at 150° C. the results were poor.

EXAMPLE 3

Cotton fabric was pretreated and dyed as in Example 1 except the solvent used for dyeing was dipropylene glycol. The photovolt reflectance was 7.0, indicating good color saturation.

EXAMPLE 4

Cotton fabric was pretreated and dyed as in Example 1 except the solvent used for dyeing was methoxy polyethylene glycol with a molecular weight of 550. The photovolt reflectance was 5.4, indicating good color saturation with a high molecular weight and high boiling solvent (460° C.).

EXAMPLE 5

Cotton fabric was soaked in an aqueous solution containing 20% KSCN for 10 minutes. The fabric was padded to 100% wet pickup and then dyed as in Example 1. After rinsing and drying the fabric, the photovolt reflectance was 3.4 which was almost identical to a similarly treated aqueous dyed fabric. The fabric was dyed a deep blue color that was more saturated than the dyed fabric pretreated with water only. This shows that color saturation upon dyeing in ethylene glycol monomethyl ether can be enhanced by pretreating the fabric with KSCN.

EXAMPLE 6

Cotton fabric was pretreated and dyed as in Example 5 except the solvent used for dyeing was dipropylene glycol. The photovolt reflectance was 4.7 which shows the effect of KSCN on color saturation compared to a reflectance of 7.0 for the fabric pretreated with water only.

EXAMPLE 7

Cotton fabric was pretreated and dyed as in Example 5 except the aqueous solution for pretreatment contained 2.5% KSCN. The fabric was dyed a deep blue color and the photovolt reflectance was 3.9 compared with 3.4 for the fabric treated with 20% KSCN.

EXAMPLE 8

Cotton fabric was pretreated and dyed as in Example 1 except that ethylene glycol monomethyl ether solvent contained 0.25% KSCN. After rinsing and drying the fabric had a deep blue color. This shows that cotton can be dyed effectively in a glycol ether solvent containing KSCN. Other inorganic salts are not as readily soluble in glycol and glycol ether solvents.

EXAMPLE 9

Cotton fabric was pretreated and dyed as in Example 8 except the ethylene glycol monomethyl ether solvent contained 2.0% KSCN. After rinsing and drying the fabric had a deep blue color that was slightly darker than the fabric obtained in Example 8.

EXAMPLE 10

Cotton fabric was pretreated and dyed as in Example 5 except that the fabric was dried prior to dyeing. The photovolt reflectance after rinsing and drying was 3.4 which was identical to the reflectance value of the fabric that was dyed in the wet state. This shows that treating fabric with a high concentration of KSCN allows excellent dye penetration into the fiber even though the cellulose is not wet with water at the time of dyeing.

EXAMPLE 11

Cotton fabric was pretreated as in Example 1 and then dyed in propylene glycol solvent containing 2% Sulfur Yellow 1 (based on weight of solution) at 150° C. for 2 minutes. The fabric was dyed a deep yellow color.

EXAMPLE 12

Cotton fabric was pretreated as in Example 5 and then dyed as in Example 11. The fabric was dyed a deep yellow color which was more saturated than the fabric in Example 11.

EXAMPLE 13

Cotton fabric was pretreated with 20% KSCN as in Example 10. The fabric was dyed with 2% Sulfur Black 1 (based on the weight of the solution) in propylene glycol at 150° C. for 2.5 minutes. The photovolt reflectance was 3.4% of the undyed control and the sample was a dark black color.

EXAMPLE 14

Cotton fabric was dyed as in Example 13 but the fabric was not treated with KSCN prior to dyeing. The photovolt reflectance was 7.6 and the fabric was a charcoal grey color.

This shows that good color saturation cannot be obtained without suitable treatment of the fabric prior to dyeing even with high temperature dyeing.

EXAMPLE 15

A 50/50 cotton/polyester blend fabric was pretreated by soaking in water as in Example 1. The fabric was dyed in propylene glycol solvent containing 1% Direct Orange 37 and 1% Disperse Yellow 3. The fabric was dyed at 130° C. for 20 minutes. The fabric was dyed an orange color. The cotton fibers were predominately orange and the polyester fibers were yellow. As a result of this dyeing, crossdyeing of a cotton/polyester fabric has been achieved by using two dye classes in a glycol solvent. Without the aqueous pretreatment dye uptake by the cotton component was poor.

EXAMPLE 16

A 50/50 cotton/polyester plated fabric was pretreated and dyed as in Example 15 except the propylene glycol solvent contained 1% Direct Orange 37 and 1% Disperse Red 60. The fabric was dyed a deep orange color on the cotton side and a brilliant red on the polyester side. This shows that both fibers had excellent dye uptake of their respective dyestuffs in propylene glycol solvent. An intimate blend fabric that was dyed as above had a reddish-orange color showing that cotton/polyester blend fabrics can be crossdyed.

EXAMPLE 17

A 50/50 cotton/polyester plated fabric was pretreated and dyed as in Example 16 except the solvent was dipropylene glycol. The results were similar to those obtained in Example 16 but the cotton side dyed deeper while the polyester side dyed lighter. The intimate blend fabric had a slightly deeper depth of shade than the corresponding fabric in Example 16.

EXAMPLE 18

A 50/50 cotton/polyester blend fabric was soaked in water and padded to 100% wet pickup. The fabric was then dyed in propylene glycol containing 1% Disperse Yellow 42 and 1% Sulfur Yellow 1 at 160° C. for 2 minutes. After rinsing and drying the fabric was dyed a deep yellow color.

EXAMPLE 19

A 50/50 cotton/polyester blend fabric was treated and dyed as in Example 18 except the fabric was pretreated with 20% KSCN and then dried prior to dyeing as in Example 18. The fabric was dyed a deep yellow color which was more saturated than the sample in Example 18.

I claim:

1. A method for dyeing cotton material in a glycol or a glycol ether solvent, said method comprising:

(a) treating the fabric with an aqueous solution containing a thiocyanate salt;

(b) dyeing the fabric with a direct or sulfur dye in a solvent selected from the group consisting of: propylene glycol, dipropylene glycol, polyethylene glycol with a molecular weight of about 400 to 600, ethylene glycol monomethyl ether, and methoxy polyethylene glycol with a molecular weight of about 120 to 550;

(c) rinsing the fabric with water to remove excess dye.

2. The method of claim 1 wherein the thiocyanate salt is selected from the group consisting of:

ammonium,
sodium, and
potassium thiocyanate.

3. The method of claim 1 including:

(a) padding to about 50 to 100% wet pickup with the aqueous solution.

4. The method of claim 1 wherein the cotton material is dyed in the glycol ether solvent from about 50° C. to 160° C. for about 20 minutes to 2 minutes.

5. The method of claim 2 including the additional step of drying the fabric which was treated with an aqueous solution containing a thiocyanate salt prior to dyeing the fabric with direct or sulfur dye in a solvent selected from the group consisting of: propylene glycol, dipropylene glycol, polyethylene glycol with a molecular weight of about 400 to 600, ethylene glycol monomethyl ether, and methoxy polyethylene glycol with a molecular weight of about 120 to 550.

6. A method for dyeing cotton material comprising:

(a) treating the fabric with water by padding to 50 to 100% wet pickup;

(b) dyeing the fabric from about 50° C. to 160° C. for about 20 minutes to 2 minutes with a direct or sulfur dye in a solvent selected from the group consisting of propylene glycol, dipropylene glycol, polyethylene glycol with a molecular weight of about 400 to 600, ethylene glycol monomethyl ether, and methoxy polyethylene glycol with a molecular weight of about 120 to 550, said selected solvent containing from about 0.25 to 2.0% potassium thiocyanate; then (c) rinsing the fabric in water to remove excess dye.

7. A method for dyeing cotton/polyester materials comprising:

(a) treating the fabric with water or an aqueous solution containing a thiocyanate salt by padding to 50 to 100% wet pickup;

(b) dyeing the fabric with a direct or sulfur dye together with a disperse dye in a solvent selected from the group consisting of: propylene glycol and dipropylene glycol; then, (c) rinsing the fabric in water to remove excess dye.

8. The method of claim 7 wherein the thiocyanate salt is selected from the group consisting of:

ammonium,
sodium, and
potassium thiocyanate.

* * * * *